US005987817A

United States Patent [19]

Hein

[11] Patent Number: 5,987,817

[45] Date of Patent: Nov. 23, 1999

[54] REVOLVING DOOR

[75] Inventor: Christian Hein, Langenhagen, Germany

[73] Assignee: Dorma GmbH + Co. KG, Ennepetal, Germany

[21] Appl. No.: 09/135,287

[22] Filed: Aug. 17, 1998

Related U.S. Application Data

[63] Continuation-in-part of application No. PCT/EP97/07031, Dec. 15, 1997.

[30] Foreign Application Priority Data

Dec. 16, 1996 [DE] Germany ..... 196 51 948

[51] Int. Cl.[6] ..... E06B 3/34

[52] U.S. Cl. ..... 49/40; 49/118

[58] Field of Search ..... 49/40, 41, 42, 49/116, 118, 123, 370

[56] References Cited

U.S. PATENT DOCUMENTS

| | | | |
|---|---|---|---|
| 4,259,810 | 4/1981 | West | 49/123 X |
| 4,341,165 | 7/1982 | Calandritti et al. | 49/42 X |
| 4,785,579 | 11/1988 | Sugiyama et al. | 49/40 |
| 4,991,347 | 2/1991 | Takimoto et al. | 49/40 |
| 5,542,211 | 8/1996 | Colombo | 49/42 |

FOREIGN PATENT DOCUMENTS

| | | | |
|---|---|---|---|
| 296134 | 12/1988 | European Pat. Off. | 49/42 |
| 2309698 | 11/1976 | France . | |
| 3928911 | 3/1990 | Germany . | |
| 4308802 | 9/1994 | Germany . | |
| 196 51 948 | 4/1998 | Germany . | |
| 2052612 | 1/1981 | United Kingdom . | |

*Primary Examiner*—Jerry Redman
*Attorney, Agent, or Firm*—Nils H. Ljungman & Associates

[57] ABSTRACT

A revolving door has at least one night closing panel that runs concentric to at least one barrel-type wall. The night closing panel or panels slide or roll on a guide rail which is located on the ceiling structure or on attachments to the ceiling structure. The night closing panels can be moved with respect to the barrel-type wall by at least one flexible, endless tension or motive device. The flexible tension device is located in a runner, whereby the two strands of the flexible tension device are restrictively guided one above the other in the runner.

6 Claims, 6 Drawing Sheets

REVOLVING DOOR

CONTINUING APPLICATION DATA

This application is a Continuation-in-Part application of International Application No. PCT/EP97/07031, filed on Dec. 15, 1997, which claims priority from Federal Republic of Germany Patent Application No. 196 51 948.9, filed on Dec. 16, 1996. International Application No. PCT/EP97/07031 was pending as of the filing date of the above-cited application. The U.S. was an elected state in International Application No. PCT/EP97/07031.

BACKGROUND OF THE INVENTION

1. Field of the Invention

The present invention relates to a revolving door which has at least one night closing panel or security panel, which panel runs concentric to at least one barrel-type wall. The panel slides or rolls on a guide rail which is located on the ceiling structure or on attachments to the ceiling structure, and the night closing panels can be moved with respect to the barrel-type wall by at least one flexible, endless tension means.

2. Background Information

British Patent Application 2 052 612 A describes a motor-driven closing device, by means of which the inner exit from a revolving door can be blocked, to prevent the entry of armed persons into the interior of a building. The closing device is driven by a motor which is located on the frame of the revolving door. The motor drives a circulating chain which, for its part, is coupled to a movable wall segment that runs centrally. Only one wall segment can be coupled to the circulating chain, i.e. the connection of two night closing panels that move in opposite directions is not possible. Moreover, in addition to the chain, a plurality of deflection pulleys are required, which makes the whole system more complex and expensive to construct and reduces its efficiency.

German Patent No. 39 28 911 C2 discloses an additional opening/closing mechanism for curved sliding doors which uses an endless belt with two horizontal strands which lie next to one another. The endless belt is thereby looped around the drive belt pulley and the driven belt pulley, whereby simultaneously the two door panels are firmly connected to the endless belt. When the drive motor is energized, the two door panels are actuated so that they move in opposite directions along left and right guide rails respectively. This type of drive mechanism is complex and expensive, because it requires a plurality of guide rollers and deflector pulleys. When toothed belts are used as the endless belt, it is also necessary to twist the toothed belts by 180° so that they can be guided on the corresponding guide rollers. The efficiency of the drive mechanism is further reduced by the friction resistances of the guide rails and rollers.

OBJECT OF THE INVENTION

Starting from the known device as described by British Patent Application 2 052 612 A, the object of the present invention is to improve a revolving door of the type described above so that when endless tension or motive means are used, one night closing panel or, optionally, two night closing panels that move in opposite directions can be connected to the tension means as required by the specific application. Alternatively, the object of the present invention is to use different tension means, e.g. roller chains or toothed belts, without thereby requiring special additional deflector pulleys or having to twist the tension means by 180°. The object of the present invention is thus a structurally simple and reliable solution in which only one drive mechanism or drive roller and a corresponding deflector pulley are necessary for the operation of the tension means.

SUMMARY OF THE INVENTION

This object can be accomplished by positioning the flexible tension or motive means so that the flexible tension means are restrictively guided in strands that lie substantially one above the other in a runner that runs substantially concentric to the night closing panel and is located on the ceiling structure or on attachments to the ceiling.

As a result of the restricted guidance of the endless tension means in strands that lie one above the other, the tension means can be guided on the drive side by means of a drive roller with a horizontal axis and on the return side by means of a deflector pulley mounted in a substantially similar fashion. A chain, preferably a roller chain, a toothed belt or a similar device can thus be used as the tension means, as required by the specific application. It is not necessary to turn the drive means, i.e. to twist it by 180°. The restricted guidance guarantees that the tension means are reliably guided both horizontally and vertically in the runner or in other words the rail or running rail or guide rail or guide, without requiring additional roller guides. The runners, or the restrictive guidance system formed by the rail, is thereby realized so that it corresponds to the curvature of the night closing panel and runs substantially centrally in relation to it, which means that, regardless of whether one or two night closing panels are used, only a single runner is required, which reduces the construction expense correspondingly.

Between the strands of the flexible tension means, there can be at least one sliding block which is connected to the night closing panel and is guided in a restricted fashion in the runner, whereby the sliding block is connected to the night closing panel by means of at least one connecting element.

As a result of the restricted guidance of the sliding block in the runner, there can be a secure and reliable connection between the flexible tension means and the night closing panel. In other words, substantially all of the forces acting on the night closing panel can be taken off of the flexible tension means by the restrictively guided sliding block, because the sliding block, for example when it is realized from a number of individual elements, can be guided over a sufficient longitudinal distance in the runner and can be provided, for example, with two connecting elements for connection to the night closing panel.

Preferably, there can be a shaft that runs through the connecting element and the night closing panel and serves as the mounting, or bearing point, for a support and guide roller, so that by means of the support and guide roller, substantially all the forces acting on the night closing panel can be transmitted to the ceiling structure. Therefore, the sliding block itself and the flexible tension means are essentially only required to absorb the tensile forces for the movement of the night closing panel. For this purpose, the sliding block can be connected with one strand of the flexible tension means by means of a driver.

One particularly advantageous configuration of the present invention can result from the use of two night closing panels that can move in opposite directions. Each of the two night closing panels can use at least one adjustable sliding block. Therefore, the one night closing panel can be connected to the lower strand and the other night closing panel can be connected to the upper strand of the flexible tension means. This advantageous configuration of the invention is the result of the arrangement of the flexible tension means in strands located one above the other in the runner. The runner can also be realized in the form of a box-type profile, and the box-type profile can have a passage slot for the connecting element so that the runner can be realized so that it is symmetrical with respect to its horizontal axis of symmetry.

The flexible tension means can advantageously be realized in the form of a roller chain. Additionally, there can be anti-wear inserts in the runner where the roller chain can be guided in a restricted manner in the anti-wear inserts. Alternatively to the roller chain, however, a toothed belt, for example, can also be used.

When the teaching of the present invention is applied, an additional advantage is that the drive of the flexible tension means can be provided by a motor with a corresponding irreversible transmission, so that there is no need for an additional closing mechanism for the night closing panels.

In other words, the drive can be provided with a self-locking or self-inhibiting transmission, so that the panels cannot move in the opposite direction once closed. The motor could be provided with, for example, an electromagnetic brake or collar that engages upon deenergization of the motor to therefore hold the panels in position. The self-locking or self-inhibiting transmission can therefore prevent the unintentional opening of the night closing panels by prohibiting the travel of each panel in the direction opposite the panel's direction of closing.

Alternatively, the night closing panels can be provided with a locking mechanism or latch or stop or another alternative mechanism to hold the closed doors in place.

As mentioned above, substantially all that is necessary for the operation of the flexible tension means is a drive mechanism on one free end of the runner that acts on a drive roller, and a deflector pulley on the other free end of the runner. To achieve a reliable guidance of the tension means in the corresponding restricted guidance mechanism, it can be advantageous to provide the deflector pulley with a tensioning device.

In an additional embodiment, the invention teaches that the drive for the flexible tension means can be designed so that it is de-energized when a power limiting mechanism located on the main closing edges of the night closing panel(s) is actuated, or if the flexible tension means are driven in the opposite direction in the sense of an opening movement of the night closing panel(s).

In one embodiment of the present invention, the power limiting mechanism can be a rubber strip or similar energy absorbing structure located on the closing edge of the door, for example a shock-absorbing mechanism. Alternatively, the power limiting mechanism can be a sensor device or other mechanical device to indicate contact of the closing edge with an opposed surface.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to at least one exemplary embodiment which is schematically illustrated in the accompanying drawings, wherein.

DESCRIPTION OF THE PREFERRED EMBODIMENT

Figure 1:
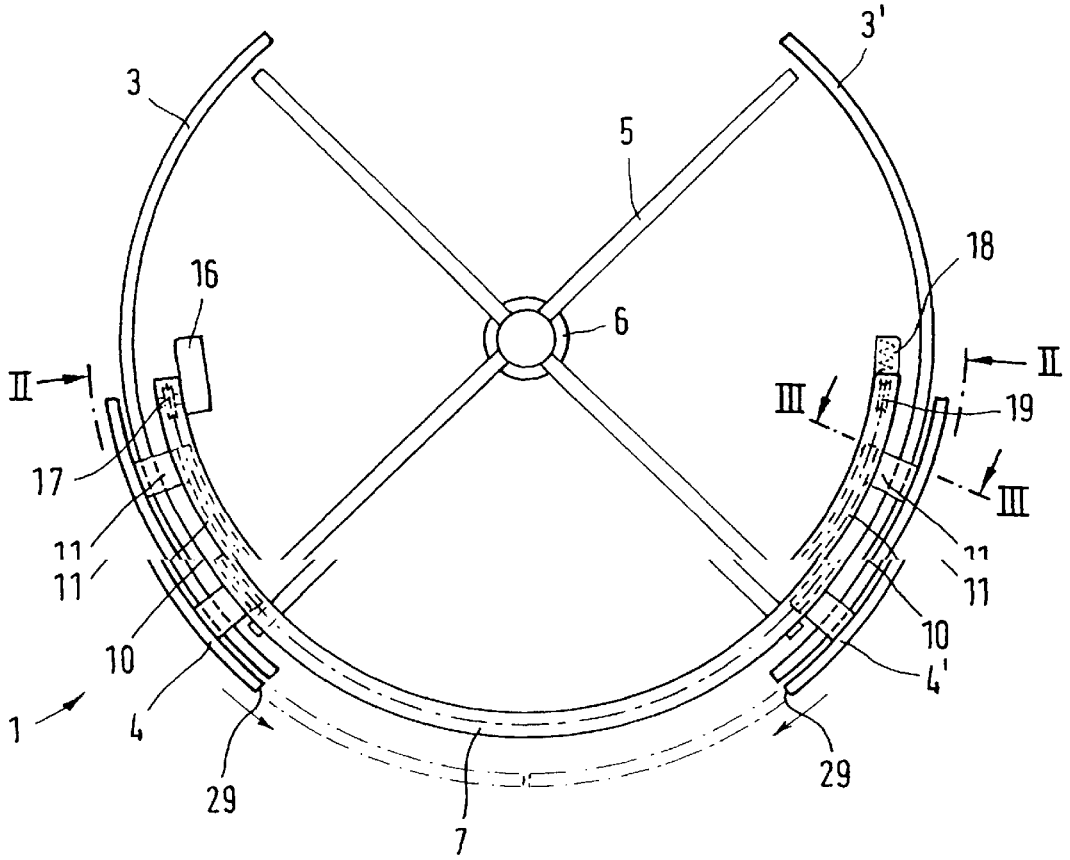
FIG. 1 shows a plan view of a revolving door, in a schematic illustration.

FIG. 1 shows a revolving door 1 which includes door panels 5 that can be rotated around a shaft 6 and are located inside barrel-type or cylindrical walls 3, 3' that define the external boundaries of the revolving door 1. Concentric to the barrel-type walls 3, 3' there are two closing panels or night closing panels 4, 4', which night closing panels 4, 4' are guided on a runner 7 by means of connecting elements 11. Flexible tension means, or endless flexible tension means, or a motive device 8 are guided in a runner or rail or guide 7. Corresponding to each night closing panel 4, 4' there is at least one connecting element 11 which is connected on one end to the night closing panel 4, 4' and on the other end to sliding blocks 10, 10' respectively, whereby, the sliding block 10 or 10' is guided in a restricted manner inside the runner 7 (see FIG. 3). FIG. 1 also shows that the flexible tension means 8 are driven by means of a drive 16 with a corresponding drive roller 17, and reversed on the other end by means of a deflector pulley 19, which deflector pulley 19 is provided with a tensioning device 18, which tensioning device 18 in at least one embodiment of the present invention can comprise a tension spring.

In at least one alternative embodiment of the present invention there may be only one night closing panel 4.

Figure 5:
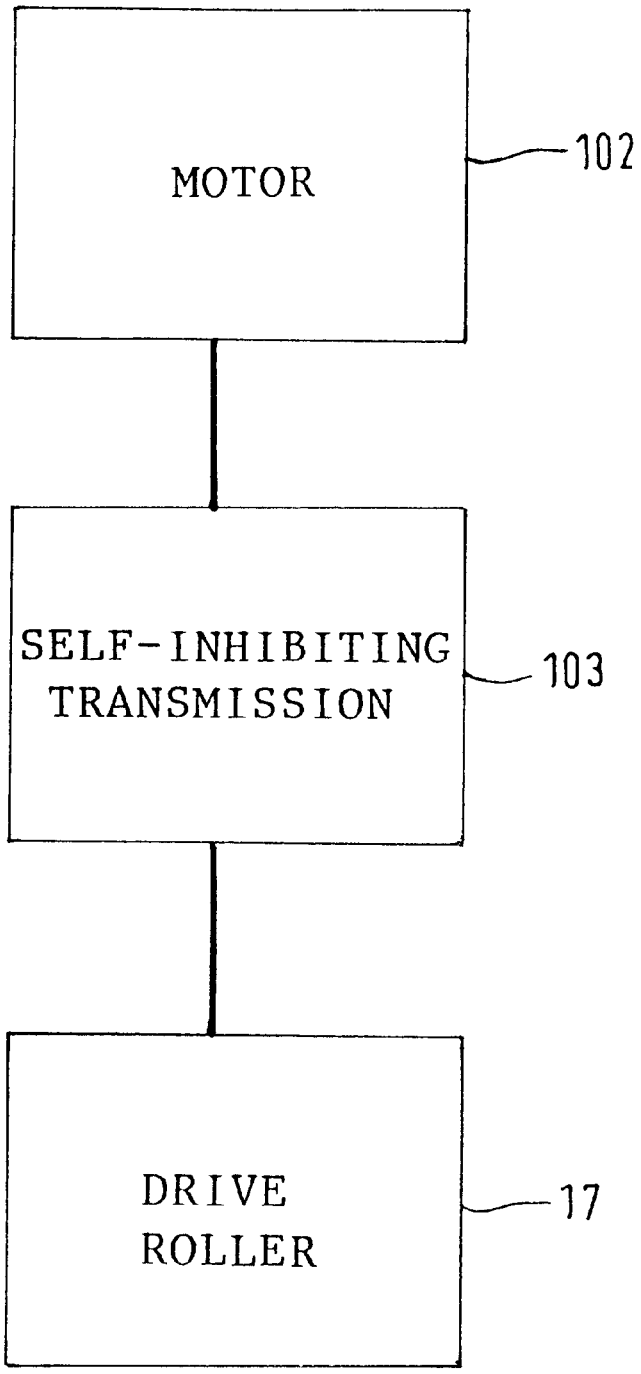
FIG. 5 shows a block diagram of an embodiment of a drive system for the revolving door.

In at least one embodiment of the present invention, the drive system 16 can include a motor 102 (see FIG. 5) connected by a self-locking or self-inhibiting transmission 103 to the drive roller 17.

Figure 2:
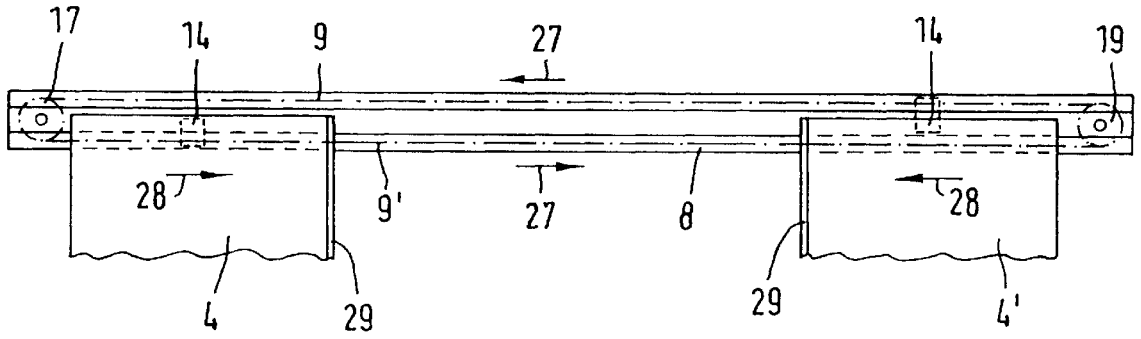
FIG. 2 shows a view in the direction indicated by the arrow II—II in FIG. 1.
Figure 2A:
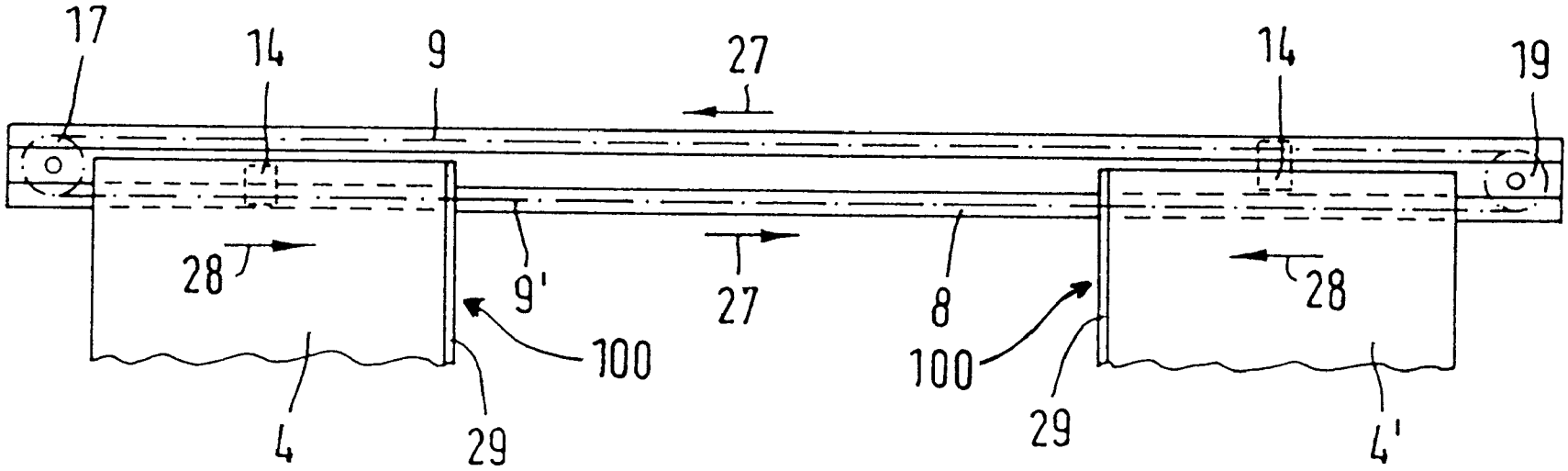
FIG. 2A shows additional detail of the Figure shown in FIG. 2.

As shown in FIGS. 1 and 2, there can be two night closing panels 4, 4', whereby (see FIG. 2) the night closing panel 4 is connected to the lower strand 9' of the flexible tension means 8 by means of a driver or connection 14 (see also FIG. 3), and the night closing panel 4' is also connected to the upper strand 9 of the flexible tension means 8 by means of a driver 14. When the drive 16 is actuated and the tension means circulate in the direction indicated by the arrow 27, the night closing panels 4, 4' thus move toward one another in the direction indicated by the arrows 28, i.e. the night closing panels are closed. On the main closing edges 29 there are force limiting devices 100 which are not illustrated in any detail (see FIG. 2A), and by means of which force limiting devices 100 the drive mechanism 16 can be de-energized or reversed.

The force limiting devices can be, in at least one embodiment of the present invention, a rubber seal or bumper, or other structure to limit the force of contact between panels.

Figure 3:
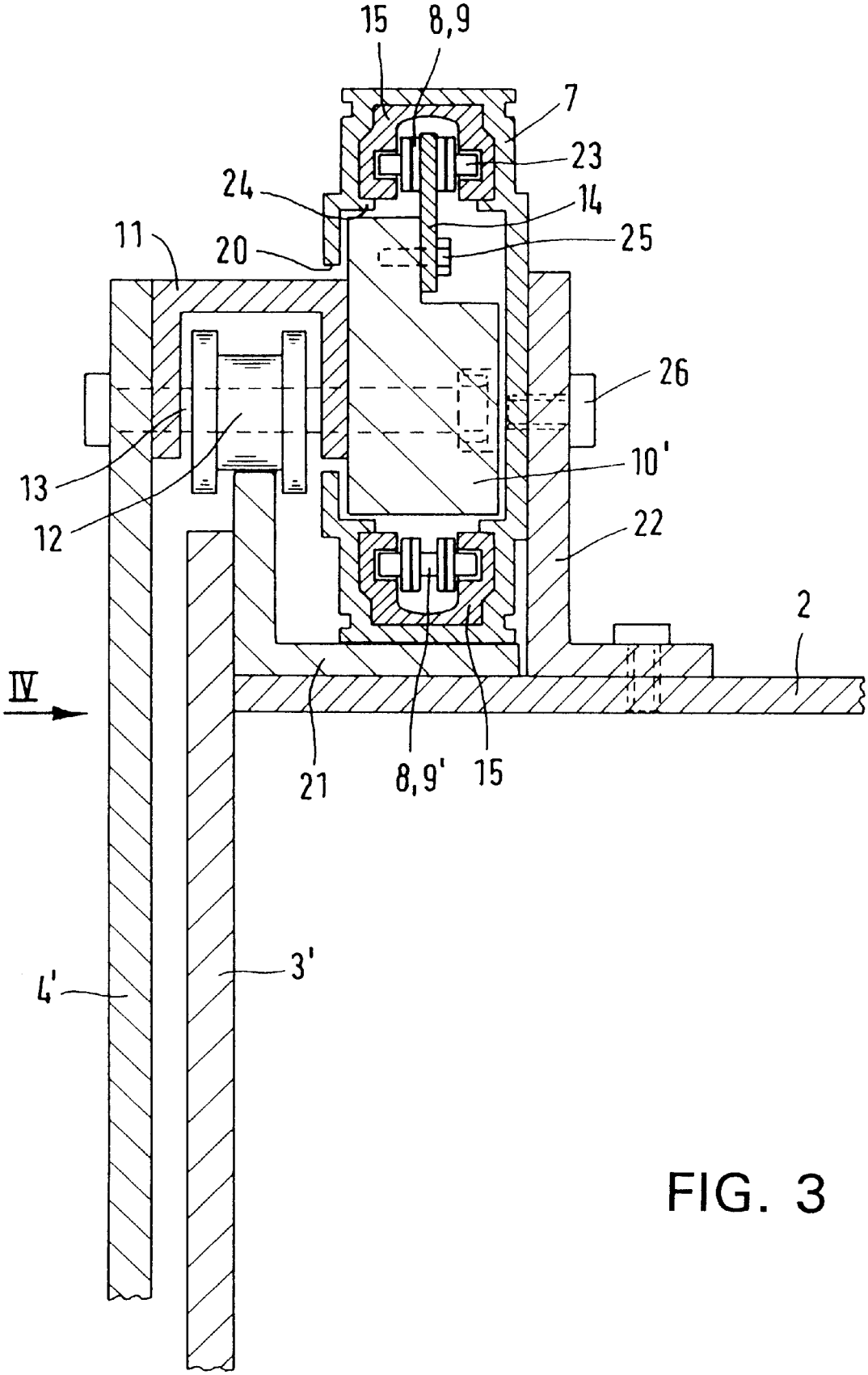
FIG. 3 shows a section along line III—III in FIG. 1, in an illustration on a larger scale.
Figure 3A:
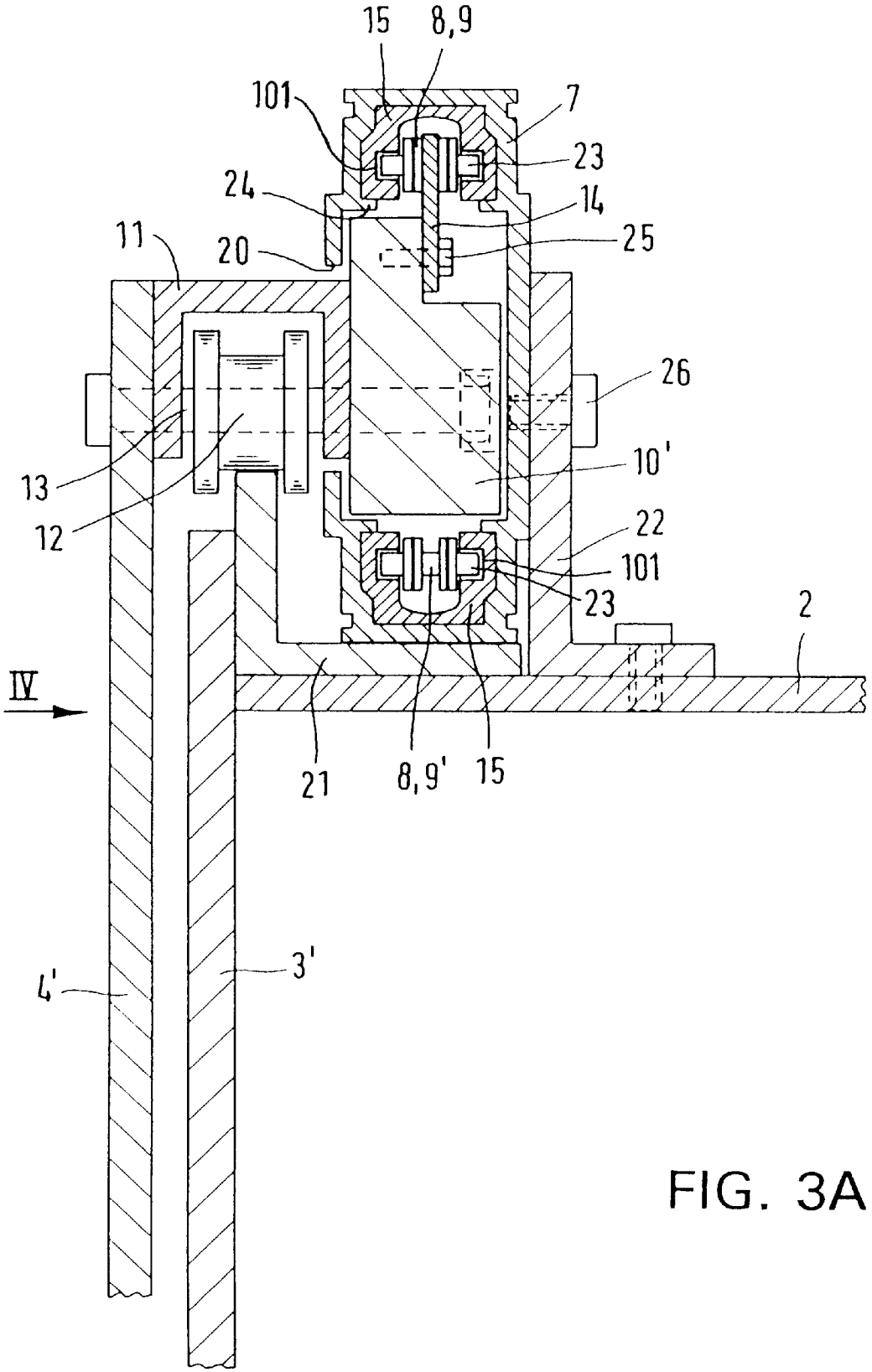
FIG. 3A shows additional detail of the Figure shown in FIG. 3.
Figure 4:
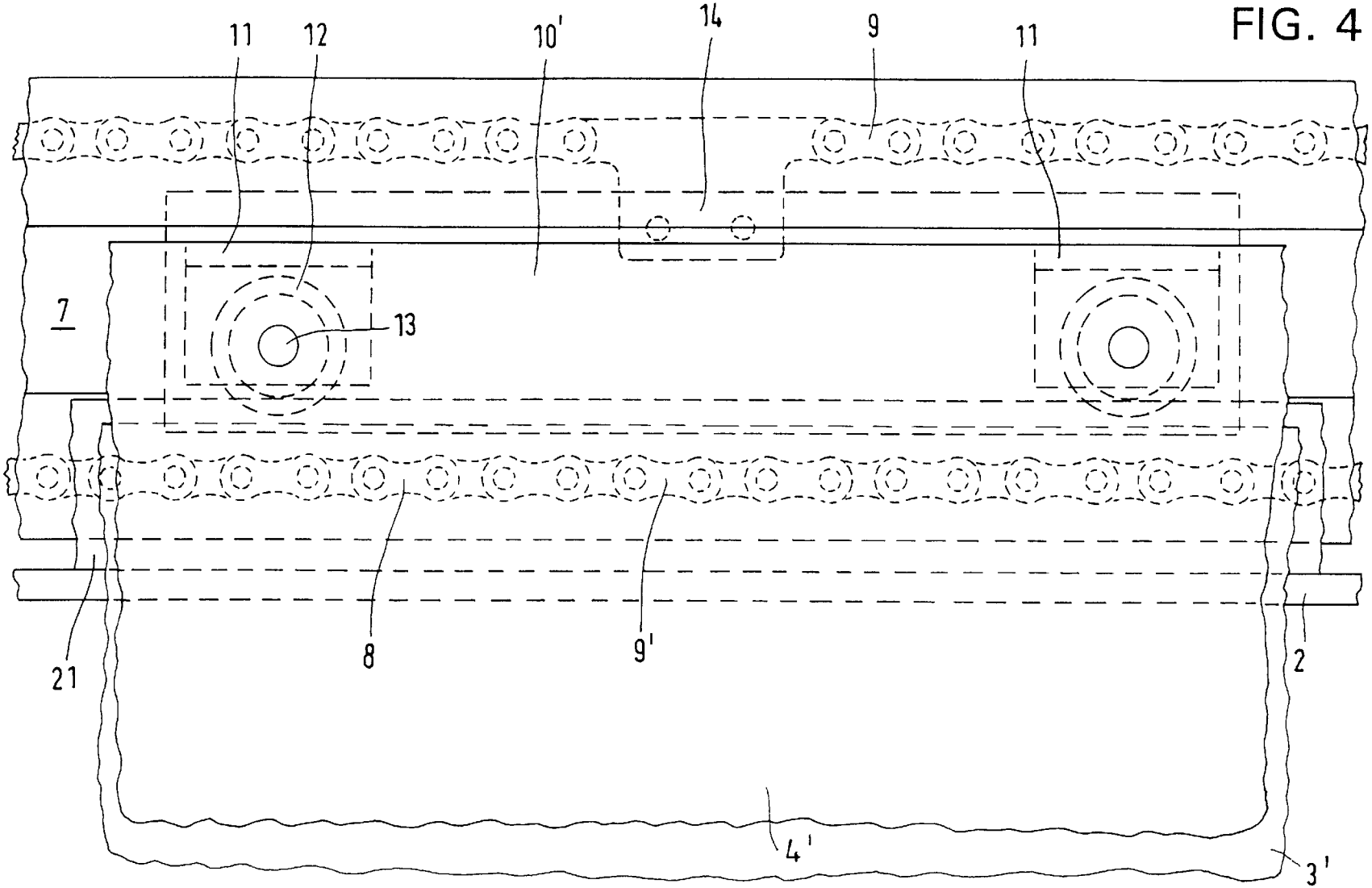
FIG. 4 shows a view in the direction indicated by the arrow IV in FIG. 3.

As shown in FIGS. 3 and 4, in the illustrated embodiment, a support bracket 22 is fastened to the ceiling structure 2 and is connected by means of a threaded connection 26 to the runner 7 which runs concentric to the barrel-type wall 3'. The runner 7 can preferably be made of an aluminum alloy. The runner 7 can be realized in the form of a box-type profile and is provided with a passage slot 20. Inside the runner 7, there are anti-wear inserts 15, in which the flexible tension means 8, which flexible tension means 8 can be realized in the form of a roller chain 8, are guided in a restricted manner. The restricted guidance is applied by axle stubs 23 located on the roller chain 8, which axle stubs 23 slide in corresponding groove-like recesses 101 (see FIG. 3A) in the anti-wear inserts 15, so that there is a restricted guidance of the chain 8 in both the vertical and horizontal directions. The anti-wear inserts 15 are preferably made of a suitable plastic. The figure shows that the chain strands 9, 9' are located substantially vertically one above the other. By means of a driver 14, the upper strand 9 of the roller chain 8 is connected to the sliding block 10' by means of a threaded connection 25. A shaft designated 13 runs through the sliding block 10' and through the connecting element 11. The connecting element 11 is realized so that it has a substantially U-shaped cross section. The shaft 13 also runs through the night closing panel 4'. A support and guide roller 12 is mounted on the shaft 13 in the vicinity of the bridge-like connecting element 11, which support and guide roller 12 is mounted on a guide rail 21 which is adjacent to the ceiling structure 2. The weight of the night closing panel 4' and substantially all of the forces acting on the night closing panel 4' are thus substantially fully transmitted to the ceiling structure 2, without thereby exerting any substantial load on the sliding block 10 or the flexible tension means 8. The support flanges 24 of the runner 7 are used essentially exclusively to guide the sliding block 10.

FIG. 4 shows that the sliding block 10' has two support and guide rollers 12. In this case, the sliding block 10' is realized in one piece, viewed lengthwise. The sliding block 10' can thereby be shaped so that it corresponds to the curvature of the runner 7, i.e. the sliding block 10' can be realized so that it is curved, or it can be divided along its length into a plurality of flexible sliding block segments that are connected to one another.

One feature of the invention resides broadly in the revolving door with at least one night closing panel that runs concentric to at least one barrel-type or cylindrical wall, which night closing panel slides or rolls on a guide rail which is located on the ceiling structure or on attachments to the ceiling structure and the night closing panels can be moved with respect to the barrel-type wall by at least one flexible, endless tension means, characterized by the fact that the flexible tension means 8 are restrictively guided in strands 9, 9' that lie one above the other in a runner that runs concentric to the night closing panel 4, 4' and is located on the ceiling structure 2 or on attachments to the ceiling.

Another feature of the invention resides broadly in the revolving door characterized by the fact that at least one adjustable sliding block 10, 10' connected to the night closing panel 4, 4' is restrictively guided in the runner 7 between the strands 9, 9' of the flexible tension means 8.

Yet another feature of the invention resides broadly in the revolving door characterized by the fact that the sliding block 10, 10' is connected to the night closing panel 4, 4' by means of at least one connecting element 11.

Still another feature of the invention resides broadly in the revolving door characterized by the fact that there are two connecting elements 11 on the sliding block 10, 10'.

A further feature of the invention resides broadly in the revolving door characterized by a shaft 13 which runs through the sliding block 10, 10', the connecting element 11 and the night closing panel 4, 4' and acts as the mounting or bearing point for a support and guide roller 12.

Another feature of the invention resides broadly in the revolving door characterized by the fact that the sliding block 10, 10' is connected with one strand 9, 9' of the flexible tension means 8 by means of a driver 14.

Yet another feature of the invention resides broadly in the revolving door characterized by the fact that there are two night closing panels 4, 4' which panels 4, 4' move in opposite directions, that corresponding to each night closing panel 4, 4' there is at least one sliding block 10, 10' and that the one night closing panel 4 is connected with the lower strand 9' and the other night closing panel 4' is connected with the upper strand 9 of the flexible tension means 8.

Still another feature of the invention resides broadly in the revolving door characterized by the fact that the runner 7 comprises a box-type profile that has a passage slot 20 for the connecting element 11.

A further feature of the invention resides broadly in the revolving door characterized by the fact that the runner 7 is realized symmetrically with respect to its horizontal axis of symmetry.

Another feature of the invention resides broadly in the revolving door characterized by the fact that the flexible tension means 8 is a roller chain.

Yet another feature of the invention resides broadly in the revolving door characterized by the fact that anti-wear inserts 15 are located in the runner 7 and the roller chain is restrictively guided in the anti-wear inserts 15.

Still another feature of the invention resides broadly in the revolving door characterized by the fact that the flexible tension means 8 is a toothed belt.

A further feature of the invention resides broadly in the revolving door characterized by the fact that the drive 16 of the flexible tension means 8 is provided by a motor with a corresponding irreversible, or self-locking or self inhibiting, transmission.

Another feature of the invention resides broadly in the revolving door characterized by the fact that on one free end of the runner 7 there is a motor drive 16 that acts on a drive roller 17, and on the other free end of the runner 7 there is a deflector pulley 19 which is provided with a tensioning device 18.

Yet another feature of the invention resides broadly in the revolving door characterized by the fact that there is a force-limiting device on the main closing edges 29 of the night closing panel 4, 4' or the night closing panels 4, 4'.

Examples of toothed belts, which may be used in embodiments of the present invention may be found in the following U.S. Patents: No. 5,178,586, issued Jan. 12, 1993 to Mizuno, et al.; No. 5,181,889, issued Jan. 26, 1993 to Maruyama, et al.; No. 5,184,352, issued Feb. 9, 1993 to Maufette; No. 5,209,961, issued May, 11, 1993 to Yukoi; No. 5,234,387, issued Aug. 10, 1993 to Fujiwara, et al.; No. 5,306,213, issued Apr. 26, 1994 to Nakajima, et al.; No. 5,322,479, issued Jun. 21, 1994 to Le Devehat; and No. 5,342,252, issued Aug. 30, 1994 to Fujiwara, et al.

Examples of linked chain belts which may be used in embodiments of the present invention may be found in the following U.S. Patents: No. RE34668, issued Aug. 9, 1994 to Lapeyre; No. 5,203,149, issued Apr. 20, 1993 to Youngberg; and No. 5,316,522, issued May 31, 1994 to Carbone et al.

Examples of brakes and electromagnetic brakes which may be used in embodiments of the drive system for the present invention, may be found in the following U.S. Patents: No. 5,185,542, issued Feb. 9, 1993 to Lazorchak; No. 5,186,286, issued Feb. 16, 1993 to Lindberg; No. 5,234,083, issued Aug. 10, 1993 to Lee; No. 5,275,261, issued Jan. 4, 1994 to Vranish; and No. 5,368,138, issued Nov. 29, 1994 to Kuivamaki.

Examples of curved tracks or guides which may be used with embodiments of the present invention may be found in the following U.S. Patents: No. 5,184,864, issued Feb. 9, 1993 to Teigen et al.; No. 5,189,837, issued Mar. 2, 1993 to Ienaga; No. 5,195,437, issued Mar. 23, 1993 to Wallace et al.; No. 5,238,283, issued Aug. 24, 1993 to Teigen; and No. RE 34360, issued Aug. 31, 1993 to Carlson, et al.

Examples of locking transmission which may be used in embodiments of the present invention may be found in the following U.S. Patents: No. 5,383,541, issued Jan. 24, 1995 to Kaplan; No. 5,388,674, issued Feb. 14, 1995 to Severinsson; No. 5,431,266, issued Jul. 11, 1995 to Ito et al.; No. 5,431,244, issued Jul. 11, 1995 to Possobom; No. 5,199,288, issued Apr. 6, 1993 to Merilainen et al.; and No. 5,251,723, issued Oct. 12, 1993 to Rolinski et al.

Examples of revolving doors, components of which may be incorporated in embodiments of the present invention, may be found in the following U.S. Patents: No. 5,187,895, issued Feb. 23, 1993 to Huber; No. 5,201,142, issued Apr. 13, 1993 to Rouwendaal; No. 5,201,906, issued Apr. 13, 1993 to Schwarz et al.; No. 5,203,111, issued Apr. 20, 1993 to Huber et al.; No. 5,235,783, issued Aug. 17, 1993 to Huber et al.; and No. 5,357,711, issued Oct. 25, 1994 to Trikilis.

Examples of force limiting devices which may be used in embodiments of the present invention may be found in the following U.S. Patents: No. 5,413,393, issued May 9, 1995 to Georgopoulos et al.; No. 5,447,071, issued Sep. 5, 1995 to Hanson; No. 5,450,657, issued Sep. 19, 1995 to Georgopoulos et al.; No. 5,455,726, issued Oct. 3, 1995 to Liu; No. 5,458,214, issued Oct. 17, 1995 to Olson et al.; and No. 5,474,105, issued Dec. 12, 1995 to Able et al.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 196 51 948, filed on Dec. 16, 1996, having inventor Christian Hein, and DE-OS 196 51 948 and DE-PS 196 51 948 and International Application No. PCT/EP97/07031, filed on Dec. 15, 1997 as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A revolving door comprising:

at least one cylindrical wall having an axis of rotation;

a central portion;

said central portion being disposed about said axis of rotation;

a plurality of door panels;

each of said plurality of door panels being disposed between said central portion and said at least one cylindrical wall;

at least one closing panel to close said revolving door to prevent entry into said revolving door;

a rail;

said rail being disposed substantially concentric to said at least one cylindrical wall;

said at least one closing panel being disposed to be guided by said rail to permit movement of said at least one closing panel along said rail;

a motive device;

said motive device being disposed and configured to move said at least one closing panel with respect to said at least one cylindrical wall to close said revolving door and to prevent entry to said revolving door;

said motive device comprising an endless belt;

said endless belt comprising a first strand and a second strand;

said rail comprising a runner;

said runner containing said first strand and said second strand;

said runner being disposed substantially concentric to said at least one closing panel;

said first strand being disposed substantially directly above said second strand in said runner;

a ceiling structure to be disposed on the ceiling of a room;

said rail being disposed on said ceiling structure;

said first strand and said second strand being configured to travel in opposite directions upon application of motive force to said endless belt;

at least one block;

said at least one block being disposed to move along said runner;

said at least one block being disposed between said first strand and said second strand of said endless belt;

at least two connecting elements for each of said at least one block;

said at least two connecting elements for each of said at least one block being disposed to connect each of said at least one block to a corresponding one of said at least one closing panel;

at least one shaft;

at least one roller;

each of said at least two connecting elements for each of said at least one block having a corresponding one of said at least one shaft;

each said connecting element being connected to its corresponding block and its corresponding closing panel by its corresponding shaft;

one of said at least one roller being disposed on a corresponding one of each of said at least one shaft;

each said shaft being disposed and configured to be a bearing for its corresponding roller;

at least one driver assembly; and each of said at least one driver assembly being disposed to connect a corresponding one of said at least one block to one of said first and second strands, to allow said corresponding block to travel along said runner.

2. The revolving door according to claim 1 wherein:

said at least one closing panel comprises two closing panels;

said at least one block comprises at least one first block and at least one second block;

one of said two closing panels is connected to said first strand by said at least one first block to move in one direction upon application of a motive force;

the other of said two closing panels is connected to said second strand by said at least one second block to move in an opposite direction upon application of a motive force;

said runner has a substantially rectangular profile;

said runner comprises a slot;

said slot of said runner being configured to receive its corresponding connection element;

said runner has a central plane, said central plane being substantially transverse to said at least one panel;

said runner has a first portion and a second portion;

said first and second portions of said runner being disposed on opposite sides of said central plane;

said first and second portions of said runner being substantially symmetrical across said central plane;

said motive device comprises a drive;

said drive comprises a motor;

said drive comprises a self-inhibiting transmission to secure said two panels;

said revolving door comprises a pulley to reverse the direction of motion of said first strand of said endless belt as compared to the direction of motion of said second strand of said endless belt;

said revolving door comprises a tension device to tension said pulley;

said runner has first and second ends disposed opposite each other;

said tension device is disposed at one end of said runner;

said drive being disposed at the other end of said runner to act on said endless belt;

each of said two closing panels comprises a main closing edge;

said main closing edges of said two closing panels are disposed to contact each other upon said two closing panels being closed;

said main closing edge of each of said two closing panels comprise a force limiting device to limit the force of said two closing panels upon contact of said two closing panels; and said endless belt comprises one of:

a roller chain, wherein said runner comprises a plurality of anti-wear inserts disposed to guide said roller chain in said runner; and a toothed chain.

3. A revolving door comprising:

at least one cylindrical wall having an axis of rotation;

at least one closing panel to close said revolving door to prevent entry into said revolving door;

a rail;

said rail being disposed substantially concentric to said at least one cylindrical wall;

said at least one closing panel being disposed to be guided by said rail to permit movement of said at least one closing panel along said rail;

a motive device;

said motive device being disposed and configured to move said at least one closing panel with respect to said at least one cylindrical wall to close said revolving door and to prevent entry to said revolving door;

said motive device comprising an endless belt;

said endless belt comprising a first strand and a second strand;

said rail comprising a runner;

said runner containing said first strand and said second strand;

said runner being disposed substantially concentric to said at least one closing panel;

said first strand being disposed substantially directly above said second strand in said runner;

a ceiling structure to be disposed on the ceiling of a room;

said rail being disposed on said ceiling structure;

said first strand and said second strand being configured to travel in opposite directions upon application of motive force to said endless belt;

at least one block;

said at least one block being disposed to move along said runner;

said at least one block being disposed between said first strand and said second strand of said endless belt;

at least two connecting elements for each of said at least one block;

said at least two connecting elements for each of said at least one block being disposed to connect the corresponding said at least one block to the corresponding said at least one closing panel;

at least one shaft;

at least one roller;

each of said at least two connecting elements having a corresponding one of said at least one shaft;

each said connecting element being connected to its corresponding block and its corresponding closing panel by its corresponding shaft;

one of said at least one roller being disposed on each of said at least one shaft;

each said shaft being disposed and configured to be a bearing for its corresponding roller;

at least one driver assembly;

each of said at least one driver assembly being disposed to connect a corresponding one of said at least one block to one of said first and second strands, to allow said corresponding block to travel along said runner;

said at least one closing panel comprising two closing panels;

said at least one block comprising at least one first block and at least one second block;

one of said two closing panels being connected to said first strand by said at least one first block to move in one direction upon application of a motive force;

the other of said two closing panels being connected to said second strand by said at least one second block to move in an opposite direction upon application of a motive force;

said runner having a substantially rectangular profile;

said runner comprising at least one slot;

each said slot of said runner being configured to receive at least a corresponding one of said at least two connection elements;

said runner having a central plane, said central plane being substantially transverse to said at least one panel;

said runner having a first portion and a second portion;

said first and second portions of said runner being disposed on opposite sides of said central plane;

said first and second portions of said runner being substantially symmetrical across said central plane;

said motive device comprising a drive;

said drive comprising a motor;

said drive comprising a self-inhibiting transmission to secure said two panels;

a pulley to reverse the direction of motion of said first strand of said endless belt from the direction of motion of said second strand of said endless belt;

a tension device to tension said pulley;

said runner having first and second ends disposed opposite each other;

said tension device being disposed at one end of said runner; and said drive being disposed at the other end of said runner to act on said endless belt.

4. The revolving door according to claim 3 wherein:

each of said two closing panels comprises a main closing edge;

said main closing edges of said two closing panels are disposed to contact each other upon said two closing panels being closed; and said main closing edge of each of said two closing panels comprise a force limiting device to limit the force of said two closing panels upon contact of said two closing panels.

5. The revolving door according to claim 4 wherein:

said endless belt comprises a roller chain;

said runner comprises a plurality of anti-wear inserts; and said plurality of anti-wear inserts are disposed to guide said roller chain in said runner.

6. The revolving door according to claim 4 wherein said endless belt comprises a toothed chain.

* * * * *